US008418434B1

(12) United States Patent
Carruth et al.

(10) Patent No.: US 8,418,434 B1
(45) Date of Patent: Apr. 16, 2013

(54) FASHION ACCESSORY OF INTEGRATED CONTINUOUS UNITS AND METHODS OF MAKING THEREOF

(76) Inventors: Jack Carruth, Woodstock, GA (US); Danielle Carruth, Woodstock, GA (US)

( * ) Notice: Subject to any disclaimer, the term of this patent is extended or adjusted under 35 U.S.C. 154(b) by 35 days.

(21) Appl. No.: 13/177,180

(22) Filed: Jul. 6, 2011

Related U.S. Application Data

(60) Provisional application No. 61/361,990, filed on Jul. 7, 2010.

(51) Int. Cl.
*F16G 13/16* (2006.01)
*F16G 15/12* (2006.01)

(52) U.S. Cl.
USPC ..... 59/83; 59/80; 59/85; 59/90; D11/12; D11/13

(58) Field of Classification Search ..... 59/78, 80, 59/82, 83, 84, 85, 90, 91, 92; D11/3, 12, D11/13
See application file for complete search history.

(56) References Cited

U.S. PATENT DOCUMENTS 429,174 A * 6/1890 Ogilvy ..... 59/78
568,531 A * 9/1896 Harthan ..... 59/83
1,257,398 A * 2/1918 Roach ..... 59/90
1,372,693 A * 3/1921 Hodges ..... 59/90
2,070,362 A * 2/1937 Kreutz ..... 59/35.1
2,840,983 A * 7/1958 Keilbach ..... 59/83
4,056,928 A * 11/1977 de Vries ..... 59/83
D338,171 S * 8/1993 Bichi ..... D11/12
5,426,788 A * 6/1995 Meltzer ..... 2/171
5,636,506 A * 6/1997 Yngvesson ..... 59/80
D450,614 S 11/2001 Wilkinson
6,880,364 B1 4/2005 Vidolin et al.
7,040,120 B2 5/2006 Hunter
7,293,429 B1 11/2007 Reichert
D592,537 S * 5/2009 Darnell ..... D11/3
2002/0043077 A1 4/2002 Boyadjian
2008/0190137 A1 8/2008 Grinstead
2009/0255295 A1 10/2009 Lane

* cited by examiner

*Primary Examiner* — David B Jones

(57) ABSTRACT

A fashion accessory featuring a plurality of units connected together to form a continuous chain having a first end and a second end. The first end and second end are connected together via a locking means. Each unit is a loop. The units each occupy a folded configuration. In the folded configuration, the unit is folded in half to form a first top arc and a second top arc that are positioned next to each other, and a first bottom hook and a second bottom hook that are positioned across from each other. Adjacent units are fed through both bottom hooks and subsequently moved to occupy the folded configuration.

8 Claims, 2 Drawing Sheets

FASHION ACCESSORY OF INTEGRATED CONTINUOUS UNITS AND METHODS OF MAKING THEREOF

CROSS REFERENCE

This application claims priority to U.S. provisional application Ser. No. 61/361,990 filed Jul. 7, 2010, the specification of which is incorporated herein by reference in its entirety.

FIELD OF THE INVENTION

The present invention is directed to a fashion accessory, more particularly to an accessory made from integrated continuous units.

BACKGROUND OF THE INVENTION

The present invention features a novel fashion accessory, which may be used for a variety of purposes and applications. For example, in some embodiments, the accessory of the present invention is used as a necklace, a bracelet, an anklet, a dog collar, a luggage tag holder, a headband, a hatband, an eyeglasses holder, a backpack accessory, a keychain, the like, or a combination thereof. The present invention is in no way limited to the aforementioned applications.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Referring now to FIGS. 1-4, the present invention features a novel fashion accessory 100. The accessory 100 of the present invention features a plurality of integrated continuous units 110, in some embodiments geometrically-shaped units. In some embodiments, the units are bands (e.g., similar to hair bands, which are well known to one of ordinary skill in the art).

As used herein, the term "connecting mechanism" refers to any appropriate linking, interlinking, looping, and interloping of the units 110.

The accessory 100 of the present invention comprises a plurality of units 110, for example a first unit 110*a*, a second unit 110*b*, a third unit 110*c*, a fourth unit 110*d*, a fifth unit 110*e*, etc. In some embodiments, the accessory 100 comprises three or more units 110. In some embodiments, the accessory 100 comprises four or more units 110. In some embodiments, the accessory 100 comprises five or more units 110. In some embodiments, the accessory 100 comprises six or more units 110. In some embodiments, the accessory 100 comprises seven or more units 110. In some embodiments, the accessory 100 comprises eight or more units 110. In some embodiments, the accessory 100 comprises nine or more units 110. In some embodiments, the accessory 100 comprises ten or more units 110.

The units 110 are loops. In some embodiments, the units 110 have a generally rounded shape (prior to integration into the accessory), similar to how a hair band has a generally rounded shape. In some embodiments, the units 110 have an alternate general shape, for example a triangular shape, a star shape, a rectangle shape, a pentagon shape, a hexagon shape, an irregular shape, etc. The present invention is not limited to the aforementioned shapes.

In some embodiments, the units 110 are flexible. In some embodiments, the units 110 are rigid. In some embodiments, the units 110 are constructed from a material comprising elastic, allowing for the units 110 to stretch.

In some embodiments, a decorative component is disposed on one or more of the unit 110. Decorative components are well known to one of ordinary skill in the art. For example, in some embodiments, the decorative component is glitter, a bead, a sticker, a flower, a bow, a key ring, a luggage tag, a dog tag, a locket, a picture, a glow-in-the dark component, the like, or a combination thereof. The present invention is not limited to the aforementioned decorative components. The decorative components may be directly or indirectly attached to the units 110.

Figure 1:
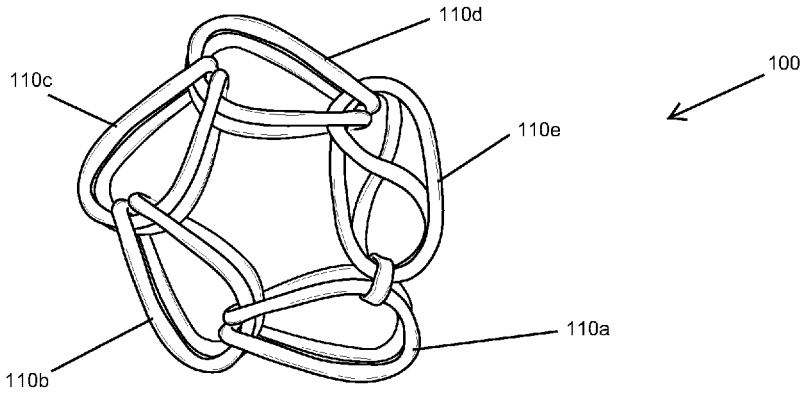
FIG. 1 is a perspective view of a fashion accessory of integrated continuous units and methods of making thereof.
Figure 2:
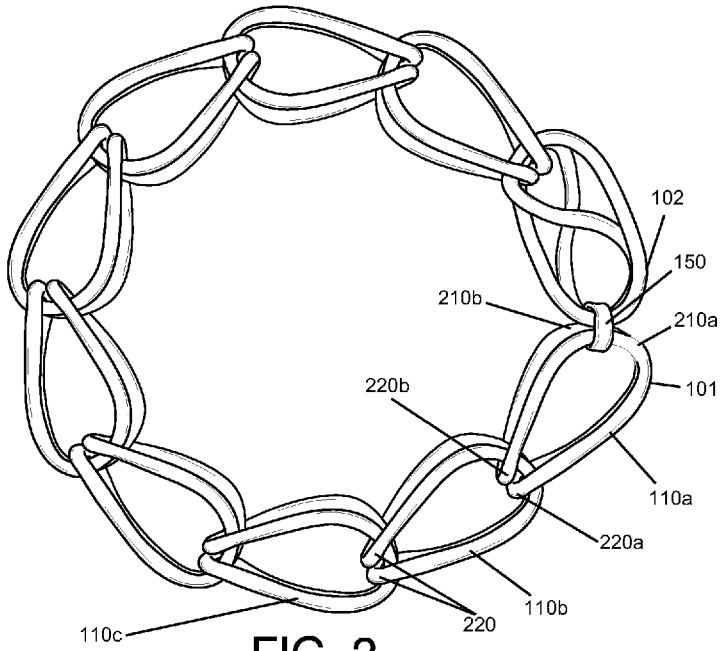
FIG. 2 is a top view of a fashion accessory of integrated continuous units and methods of making thereof.
Figure 3:
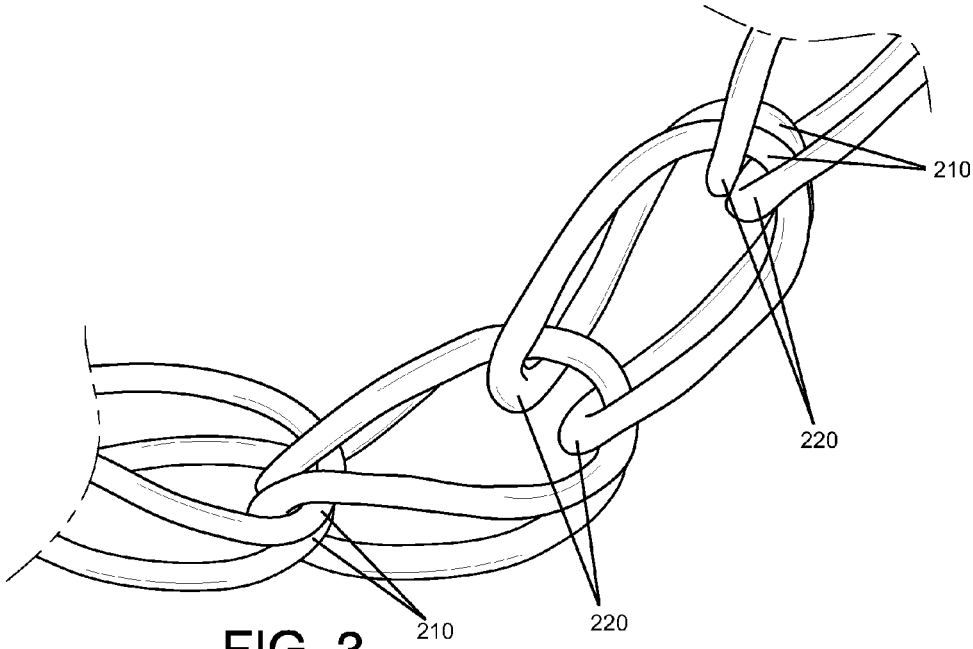
FIG. 3 is an exploded view of a fashion accessory of integrated continuous units and methods of making thereof.
Figure 4:
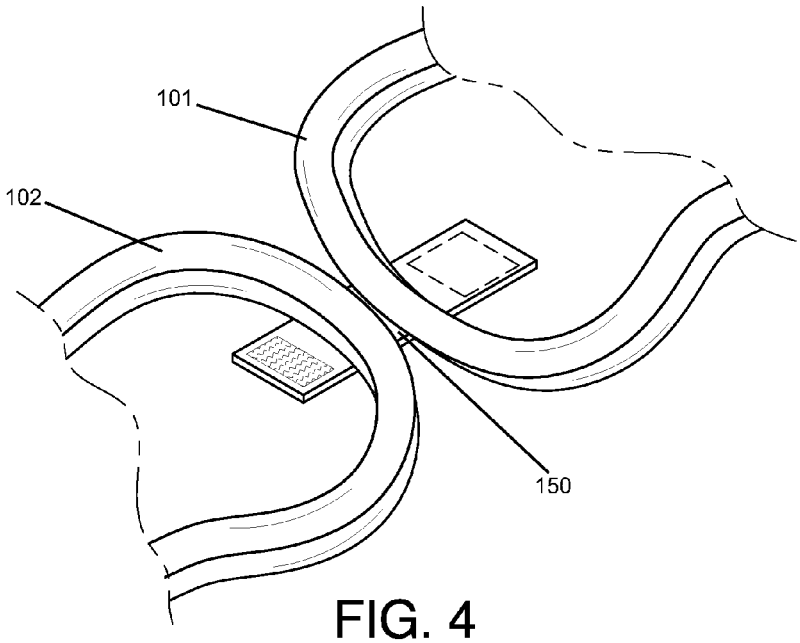
FIG. 4 is an alternate embodiment of a fashion accessory of integrated continuous units and methods of making thereof.

The units 110 are interlocked to form a continuous chain (e.g., via a connecting mechanism). For example, as shown in FIG. 3, to form the chain, a first unit 110*a* is folded (e.g., in half) in a folded configuration, wherein the folded configuration has a first top arc 210*a* and a second top arc 210*b* that are positioned next to each other, and a first bottom hook 220*a* and a second bottom hook 220*b*, wherein the bottom hooks 220 are positioned across from each other. A second unit 110*b* is fed through both bottom hooks 220 of the first unit 110, then the second unit 110*b* is folded to the folded configuration (as described above). A third unit 110*c* is fed through both bottom hooks 220 of the second unit 110, then the third unit 110*c* is folded to the folded configuration (as described above). Additional units 110 are added as described until a desired length or number of units 110 is achieved.

When the units 110 are interlocked to form a continuous chain, the accessory has a first end 101 and a second end 102. The first end 101 and second end 102 can be connected together via a locking means 150. The locking means 150 may be one or more of any securing or locking devices well known to one of ordinary skill in the art, for example a mating-type engagement, e.g., a clip mechanism, a snap mechanism, a hook mechanism, a latch mechanism, a magnet mechanism, a hook-and-loop fastener mechanism, the like, or a combination thereof. Other similar mechanisms are well known to one of ordinary skill in the art. In some embodiments, the ends 101, 102 are temporarily connected together or permanently connected together.

As used herein, the term "about" refers to plus or minus 10% of the referenced number. For example, an embodiment wherein the accessory 100 is about 10 inches in length as measured from the first end 101 to the second end 102 includes an accessory 100 that is between 9 and 11 inches in length.

The disclosures of the following U.S. Patents are incorporated in their entirety by reference herein: U.S. Design Pat. No. D450614; U.S. Pat. No. 6,880,364; U.S. Pat. No. 7,040,120; U.S. Pat. No. 7,293,429; U.S. Design Pat. No. D592537;

U.S. Patent Application No. 2002/0043077; U.S. Patent Application No. 2008/0190137; U.S. Patent Application No. 2009/0255295.

EXAMPLE 1

Construction

Example 1 describes an example of constructing the accessory 100 of the present invention. In some embodiments, the accessory 100 of the present invention is constructed by linking the units 110 through a predetermined looping or linking guide; however, the present invention is not limited to this manufacturing or construction process or method. The guide may, for example, comprise a linear device continuous from a first end and a second end, wherein the first end and the second end are each open ends of the guide. The guide may be replaced with any other type device that services the same function as would be evident and obvious to those of ordinary skill in the art.

In some embodiments, a first unit 110*a* is placed against the guide such that the first unit 110*a* is folded substantially or in part back over on itself over a dominant axis of the guide, thereby creating a smaller area of overlapping enclosed space within the band when viewing from an axis perpendicular to the fold and where such enclosed space is also partially defined by the guide (e.g., or if not guide is used, defined partially by the axis of the fold). A second unit 110*b* is then placed through such newly created smaller interior space of the first unit 110*a* and the second band 110*b* is similarly folded upon itself to create a smaller interior space while partially remaining within the smaller created interior space of the first unit 110*a*, thereby linking the first unit 110*a* and the second unit 110*b* without compromising the continuity of the units 110. A third unit 110*c* is then placed within the newly created smaller interior space of the second unit 110*b* along the same method as previously described. Similarly, the third unit 110*c* is then folded upon itself while still remaining partially enclosed within the smaller created enclosed interior space of the second unit 110*b*. More units 110 can be added depending on the desired length for the article.

When the desired length and/or desired number of units 110 has been achieved, the accessory 100 has a first end 101 and a second end 102. The first end 101 and the second end 102 can be connected via a locking means 150. The locking means 150 may be one or more of any securing or locking devices well known to one of ordinary skill in the art, for example a mating-type engagement, e.g., a clip mechanism, a snap mechanism, a hook mechanism, a latch mechanism, a magnet mechanism, a hook-and-loop fastener mechanism, the like, or a combination thereof. Other similar mechanisms are well known to one of ordinary skill in the art.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A fashion accessory (100) comprising a plurality of units (110) connected together to form a continuous chain having a first end (101) and a second end (102), the first end (101) and second end (102) are connected together via a locking means (150), wherein a unit (110) is a generally round loop that is elastic and flexible, wherein the units (110) each occupy a folded configuration, in the folded configuration the unit (110) is folded in half to form a first top arc (210*a*) and a second top arc (210*b*) that are positioned next to each other, and a first bottom hook (220*a*) and a second bottom hook (220*b*) that are positioned across from each other, wherein adjacent units (110) are fed through both bottom hooks (220) and subsequently moved to occupy the folded configuration;

wherein the unit (110) is a flexible, elastic hair band.

2. The accessory (100) of claim 1 comprising six or more units (110).

3. The accessory (100) of claim 1 comprising eight or more units (110).

4. The accessory (100) of claim 1 comprising ten or more units (110).

5. The accessory (100) of claim 1 comprising twelve or more units (110).

6. The accessory (100) of claim 1, wherein a decorative component is disposed on one or more of the units (110).

7. A fashion accessory (100) consisting of a plurality of units (110) connected together to form a continuous chain having a first end (101) and a second end (102), the first end (101) and second end (102) are connected together via a locking means (150), wherein a unit (110) is a generally round loop that is elastic, and flexible, wherein the units (110) each occupy a folded configuration, in the folded configuration the unit (110) is folded in half to form a first top arc (210*a*) and a second top arc (210*b*) that are positioned next to each other, and a first bottom hook (220*a*) and a second bottom hook (220*b*) that are positioned across from each other, wherein adjacent units (110) are fed through both bottom hooks (220) and subsequently moved to occupy the folded configuration;

wherein the unit (110) is a flexible, elastic hair band.

8. A method of forming a novel fashion accessory (100) from a plurality of flexible, elastic hair band units (110) comprises:

(a) obtaining a plurality of units (110);

(b) folding a first unit (110*a*) in half to a folded configuration, wherein the folded configuration has a first top arc (210*a*) and a second top arc (210*b*) that are positioned next to each other, and a first bottom hook (220*a*) and a second bottom hook (220*b*) that are positioned across from each other;

(c) feeding a second unit (110*b*) through the first bottom hook (220*a*) and the second bottom hook (220*b*) of the first unit 110;

(d) folding the second unit (110*b*) to the folded configuration;

(e) feeding a third unit (110*c*) through the first bottom hook (220*a*) and the second bottom hook (220*b*) of the second unit (110);

(f) folding the third unit (110*c*) to the folded configuration;

(g) repeating the steps (c) through (f) of feeding, then folding, for additional unit (110) until a desired length or number of units (110) is achieved, wherein the units 110 are interlocked to form a continuous chain, wherein the accessory has a first end 101 and a second end 102;

(h) connecting the first end (101) and the second end (102) together via a locking means (150).

* * * * *